US011659924B2

(12) United States Patent
Tingle et al.

(10) Patent No.: US 11,659,924 B2
(45) Date of Patent: May 30, 2023

(54) MULTI-LEVEL CABINET STORAGE SYSTEM

(71) Applicant: Rev-A-Shelf Company, LLC, Louisville, KY (US)

(72) Inventors: Bryan Keith Tingle, Shelbyville, KY (US); Paul Franklin Chambers, Louisville, KY (US); Kevin M. Ward, Louisville, KY (US); Leeman Elliot Stevens, Shelbyville, KY (US)

(73) Assignee: REV-A-SHELF COMPANY, LLC, Louisville, KY (US)

( * ) Notice: Subject to any disclaimer, the term of this patent is extended or adjusted under 35 U.S.C. 154(b) by 0 days.

(21) Appl. No.: 17/068,559

(22) Filed: Oct. 12, 2020

(65) Prior Publication Data

US 2021/0022492 A1 Jan. 28, 2021

Related U.S. Application Data

(63) Continuation of application No. 16/422,282, filed on May 24, 2019, now Pat. No. 10,799,020.

(51) Int. Cl.
*A47B 46/00* (2006.01)
*A47B 95/00* (2006.01)

(52) U.S. Cl.
CPC ..... *A47B 46/00* (2013.01); *A47B 95/00* (2013.01)

(58) Field of Classification Search
CPC ..... A47B 46/00; A47B 95/00; A47B 88/42; A47B 88/423; A47B 88/956; A47B 88/95; A47B 2088/422; A47B 2088/421; A47B 2088/4274; A47B 2088/4276
USPC ..... 312/249.1, 301, 330.1, 348.4
See application file for complete search history.

(56) References Cited

U.S. PATENT DOCUMENTS

| | | | |
|---|---|---|---|
| 2,327,761 | A | 8/1943 | Brodbeck |
| 3,033,639 | A | 5/1962 | Emery |
| 3,201,187 | A | 8/1965 | Reiss, Sr. et al. |
| 3,874,756 | A | 4/1975 | Greene |
| 4,441,773 | A | 4/1984 | Leiper |
| 5,641,216 | A | 6/1997 | Grass |
| 6,116,706 | A | 9/2000 | Pomerleau et al. |
| 6,135,584 | A | 10/2000 | Happ |
| 6,481,812 | B1 | 11/2002 | Domenig et al. |
| 6,485,120 | B1 | 11/2002 | Pomerleau et al. |
| 6,694,544 | B2 | 2/2004 | Piatt |

(Continued)

*Primary Examiner* — Janet M Wilkens
*Assistant Examiner* — Timothy M Ayres
(74) *Attorney, Agent, or Firm* — Crowell & Moring LLP

(57) ABSTRACT

A multi-level cabinet storage system includes a multi-level storage container that includes a number of shelves, each with horizontal planar surfaces, coupled between the vertical opposing members. The horizontal planar surfaces of respective shelves may be aligned vertically in parallel planes. The vertical opposing members may include a rear vertical member and a front vertical member. The multi-level cabinet storage system also includes a first slide member coupled with a base of the multi-level storage container and a second slide member coupled at a first end with the rear vertical member and extending parallel with, and along, a horizontal planar surface of an upper shelf included among the shelves. The multi-level cabinet storage system also includes an external frame formed as a contiguous rigid structure coupled with the first slide member and the second slide member.

16 Claims, 6 Drawing Sheets

(56) References Cited

U.S. PATENT DOCUMENTS

| | | | | |
|---|---|---|---|---|
| 7,306,301 | B2 | 12/2007 | Walburn | |
| D596,424 | S | 7/2009 | Noe et al. | |
| 8,047,621 | B2 | 11/2011 | Walburn | |
| 8,220,884 | B2 | 7/2012 | Berger | |
| 8,388,076 | B2 | 3/2013 | Walburn | |
| 8,585,165 | B2 | 11/2013 | Liang et al. | |
| 8,733,865 | B1 | 5/2014 | Chambers et al. | |
| 8,870,313 | B2 | 10/2014 | Grabherr et al. | |
| 9,125,490 | B2 * | 9/2015 | Haemmerle | A47B 88/40 |
| 9,565,936 | B2 | 2/2017 | Chen et al. | |
| 9,661,924 | B2 | 5/2017 | Chen | |
| 9,723,922 | B2 | 8/2017 | Chen | |
| 9,756,941 | B1 | 9/2017 | Rowland | |
| 9,848,700 | B2 | 12/2017 | Corless | |
| 10,251,480 | B2 | 4/2019 | Chen | |
| 10,285,500 | B2 * | 5/2019 | Stuffel | A47B 88/407 |
| 10,314,396 | B2 | 6/2019 | Hsu | |
| 2012/0217857 | A1 * | 8/2012 | Grabherr | A47B 88/427<br>248/214 |
| 2012/0292465 | A1 * | 11/2012 | Holzer | B60W 50/0097<br>248/221.11 |
| 2013/0088134 | A1 | 4/2013 | Varner et al. | |
| 2014/0375197 | A1 | 12/2014 | Hilldebrand-Prinz | |
| 2018/0146782 | A1 * | 5/2018 | Boekhoff | A47B 88/427 |
| 2021/0186212 | A1 * | 6/2021 | Petker | A47B 88/427 |

* cited by examiner

MULTI-LEVEL CABINET STORAGE SYSTEM

RELATED APPLICATION(S)

This application is a continuation of U.S. patent application Ser. No. 16/422,282, filed May 24, 2019, which is entirely incorporated herein by reference.

FIELD

The present disclosure relates generally to a multi-level cabinet storage system for use in a cabinet or other enclosure.

BACKGROUND

Cabinets such as storage cabinets for kitchens, bathrooms, closets, offices and other uses can include one or more receptacles, such as drawers or shelves for storing articles. The drawers and shelves can be designed to be moved between an open position and a closed position. While in the open position, a drawer or shelf may be extended away from the storage cabinet or other enclosure so as to receive the articles. In the closed position, the drawer or shelf may be recessed within the storage cabinet or other enclosure in which the drawer or shelve is installed. The size and weight of such drawers or shelves can vary. In addition, the weight and/or number of articles that can be stored on the drawers or shelves can be quite different in different applications.

SUMMARY

Further areas of applicability will become apparent from the description provided herein. It should be understood that the description and specific examples are intended for purposes of illustration only and are not intended to limit the scope of the present disclosure.

A cabinet storage system may include a multi-level storage container comprising a first horizontal shelf in a vertically spaced relation to a second horizontal shelf and a front vertical member and a rear vertical member. The first horizontal shelf and the second horizontal shelf may be transversely coupled between the front vertical member and the rear vertical member. The system may also include a first slide member and a second slide member coupled with opposing sides of the multi-level storage container. The first slide member may extend horizontally along the first horizontal shelf and the second slide member may extend horizontally along the second horizontal shelf into apertures formed in the first and second vertical members.

Another example cabinet storage system includes a slidable multi-level storage container. The multi-level storage container includes a plurality of vertically spaced horizontal shelves positioned between opposing vertical members and a set of slide members. The multi-level storage container may be configured to be aligned in a cabinet and extend horizontally in parallel to a first slide member and a second slide member included in the set. The first slide member may be coupled with a base of the slidable multi-level storage container, and the second slide member may be coupled with at least one of the opposing vertical members via a keeper bracket. The second slide member may extend along a shelf included among the vertically spaced shelves. The shelf is an upper shelf, which is vertically spaced away from the base.

An interesting feature of the cabinet storage system relates to a keeper bracket coupled to the front vertical member and extending into one of the apertures included in the front vertical member. The second slide member may be coupled with the keeper bracket in the one of the apertures.

Another interesting feature of the cabinet storage system relates to the keeper bracket, which is fixedly coupled with the second slide member to maintain the second slide member in an aperture included in front vertical member without contiguous contact with the front vertical member.

Still another interesting feature of the cabinet storage system is an external frame included therein. The external frame may be a contiguous rigid structure coupled with the first slide member and the second slide member.

Yet another interesting feature of the cabinet storage system relates to the external frame, which includes a horizontal section and a vertical section. The horizontal section extends transverse to the first slide member below the base, and the vertical section extends transverse to the second slide member and the shelves.

Still another interesting feature of the cabinet storage system relates to the horizontal section of the external frame, which includes a first member pivotally coupled with a second member by a hinge.

Other systems, methods, features and advantages will be, or will become, apparent to one with skill in the art upon examination of the following figures and detailed description. It is intended that all such additional systems, methods, features and advantages be included within this description, be within the scope of the invention, and the following claims.

DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
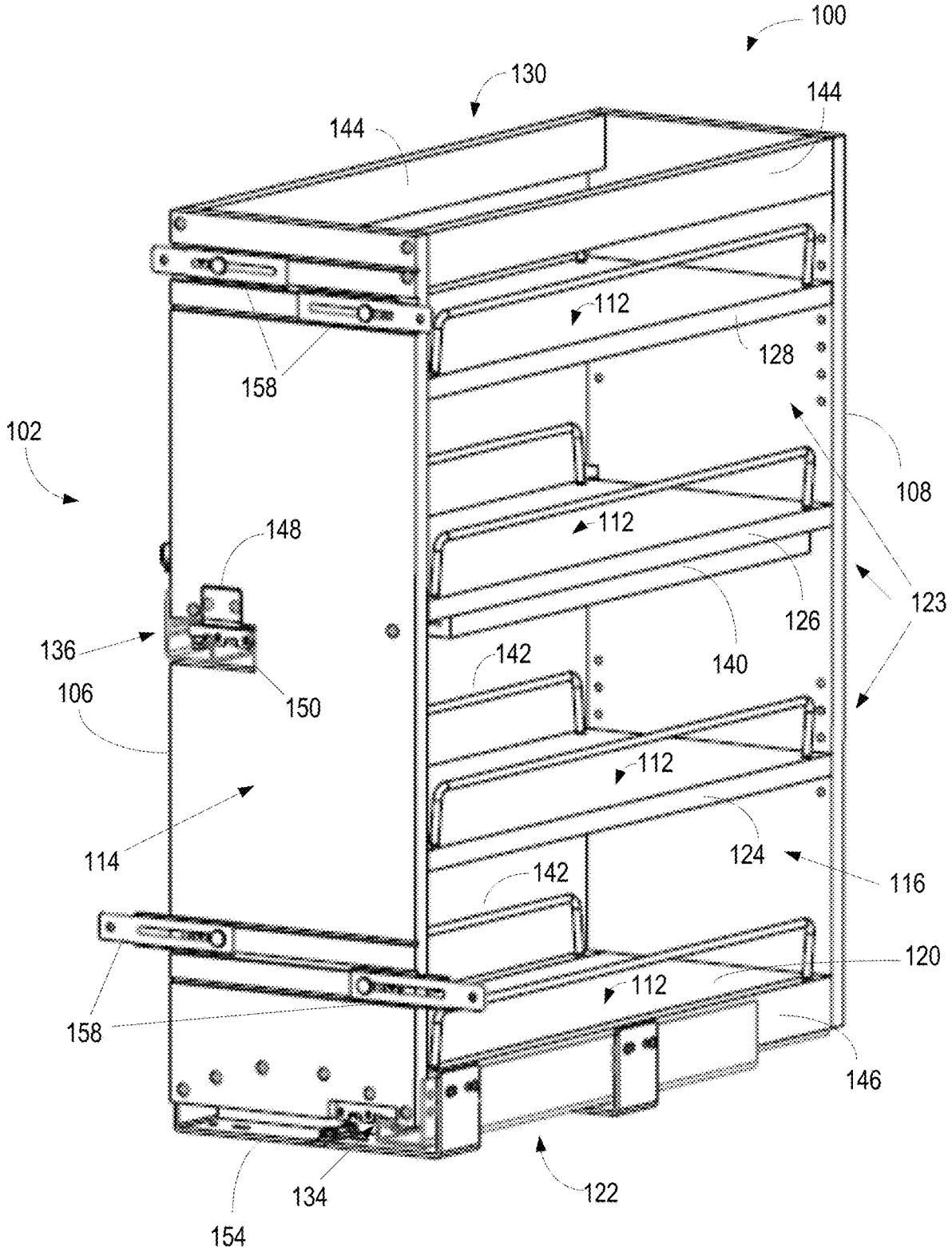
FIG. 1 is a perspective view of an example multi-level cabinet storage system.

FIG. 1 is an example of a multi-level cabinet storage system 100. The multi-level cabinet storage system 100 includes a multi-level storage container 102. The multi-level storage container 102 includes multiple shelves 104, a front or first vertical member 106 and a rear or second vertical member 108. The vertical members 106 and 108 are opposing vertical members. Each of the shelves 104 are horizontal shelves having horizontal planar surfaces 112, which are aligned vertically in different parallel planes defined by the horizontal planar surfaces 112 in the multi-level cabinet storage system 102. The front and rear vertical members 106 and 108 are vertical opposing members forming a front face 114 and a rear wall 116 of the multi-level storage container 102. The shelves 104 and front and rear vertical members 106 and 108 may be made of wood, metal, plastic, composite, and/or any other rigid material. In an example, the shelves 104 and front and rear vertical members 106 and 108 are made of wood. In another example, the shelves 104 are made of metal, such as in the form of wire, and the front and rear vertical members 106 and 108 are made of wood or plastic. In other examples, other configurations of rigid materials may be used.

The shelves 104 are fixedly coupled between the front and rear vertical opposing members 106 and 108 such that the planar surfaces 112 are transversely aligned with vertical planes defined by the front and rear vertical members 106 and 108. The shelves 104 include a first shelf 120 proximate a base 122 of the multi-level storage container 102, and one or more upper shelves 123 vertically spaced above the first shelf 120. In the example of FIG. 1, the upper shelves 123 include a second shelf 124 and a third shelf 126 positioned as centrally located middle shelves in a vertically space configuration between the first shelf 120 and a fourth shelf 128, or top shelf, vertically positioned near a top end 130 of the multi-level storage container 102 as one of the upper shelves 123. In other examples, any number of one or more upper shelves 123 may be vertically positioned above the bottom shelf 120. In still other examples, the bottom shelf 120 or the top shelf 128, or both the bottom shelf 120 and the top shelf 128 may omitted such that only middle shelves 124 and 126 are present as the upper shelves 123. In any of the examples described, the multi-level storage container 102 may include any of one or more upper shelves 123 above the first shelf 120.

The multi-level storage system 100 also includes a set of slide members positioned on opposing sides of the multi-level storage container 102. The opposing sides are represented by the side edges of the multi-level storage container 102, which may include lateral opposing edges of the shelves 120, 124, 126, 128. The set of slide members include a first slide member 134 and a second slide member 136. The first slide member 134 is coupled with the base 122 of the multi-level storage container 102. The second slide member 136 extends in parallel with and along the horizontal planar surface 112 of one of the upper shelves 123, such as the third shelf 126.

An upper shelf 123, such as the third shelf 126, along which the second slide member 136 extends, may include a stiffening member 140. The stiffening member 140 may be contiguously aligned with the upper shelf 123 to provide support of the upper shelf 123 against torsional or twisting, as well as vibration or swaying. The stiffening member 140 may be a planar member of similar size and shape to the upper shelf 123, may be one or more struts, or may be any other form of rigid member to prevent twisting, mis-alignment of the upper shelf 123, or swaying of the multi-level storage container 102. In other examples, the stiffening member 140 may be omitted.

Each of the shelves 120, 124, 126 and 128 may include rails 142 positioned on lateral opposing sides of the shelves 120, 124, 126 and 128. The rails 142 may be any rigid material, such as metal. The rails 142 may be mounted on the horizontal planar surface 112 to extend transverse thereto.

The multi-level storage container 102 may also include upper struts 144 positioned at the top end 130 and lower struts 146 positioned at the base 122. The upper struts 144 and the lower struts 146 may extend between the front vertical member 106 and the rear vertical member 108 to provide structural support to the multi-level storage container 102.

The multi-level storage system 100 also includes a keeper bracket 148. The keeper bracket 148 may be made of any rigid material, such as metal. The keeper bracket 148 may be coupled with the front vertical member 106 and with the second slide member 136. The keeper bracket 148 may be coupled between the second slide member 136 and the front vertical member 106 to rigidly maintain the second slide member 136 in an aperture 150 formed in the front vertical member 106.

The set of slide members (first and second slide members 134 and 136) may be coupled with an external frame 154. The external frame 154 may be formed as a contiguous rigid structure providing structural support to the multi-level storage container 102 by being coupled to a cabinet in which the multi-level storage system 100 is mounted. The external frame may be formed of a rigid material, such as metal.

The multi-level storage system 100 may also include lateral support brackets 158 proximate the base 122 and the top end 130. The lateral support brackets 158 may be mounted on the front face 114 of the front vertical member 106, and be slidably extendible laterally outward for coupling a drawer front or cabinet front to the front face 114 of the multi-level storage container 102.

The external frame 154 may minimize torsional twisting, vibration and/or swaying of the multi-level storage container 102. The stiffening member 140, upper and lower struts 144 and 146 and/or the support brackets 158 may also minimize torsional twisting, vibration and/or swaying of the multi-level storage system 102. Such movement may be minimized when the shelves 120, 124, 126 and 128 are loaded with materials, such as cans or other containers. Thus, when the multi-level storage container 102 is slidabley moved between being inside a cabinet and extending outside a cabinet using the set of slides 134 and 136, vibration, twisting and swaying is minimized.

Figure 2:
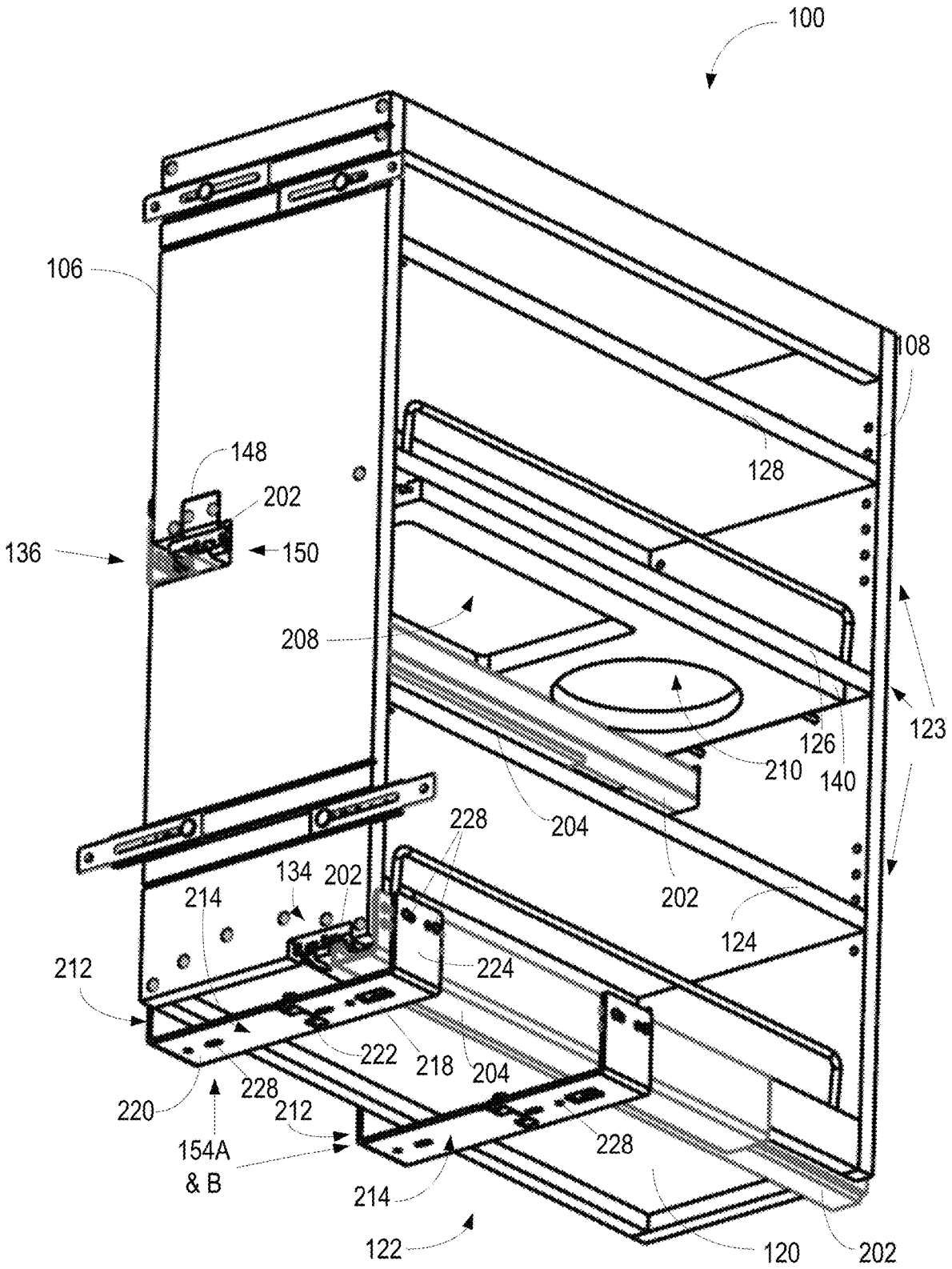
FIG. 2 is bottom perspective view of an example multi-level storage system.

FIG. 2 is bottom perspective view of an example multi-level storage system 100. The multi-level storage container 102 included in the multi-level storage system 100 includes the external frame 154 coupled with the first slide member 134 and the second slide member 136. Each of the slide members 134 and 136 are telescoping slide members which include a slideable portion 202 and a fixed base portion 204. The slideable portion 202 is coupled with the multi-level storage container 102, and the fixed base portion 204 may be coupled with the external frame 154, so that the slidable portion 202 and the multi-level storage container 102 are movable together to extend away from the external frame 154 in order to be positioned outside the cabinet in which the multi-level storage system 100 is mounted. Unless otherwise indicated, the features and functionality of the multi-level cabinet system 100 discussed with reference to FIG. 1 are similar to the features and functionality of the multi-level cabinet system 100 discussed with reference to FIG. 2. Accordingly, for purposes of brevity the details of these features and functionality will not be fully repeated, and it should be understood that features and functionality are fully interchangeable, combinable, and/or useable in the example systems described herein.

In FIG. 2, the external frame 154 includes a first external frame 154*a* and a second external frame 154*b* independently coupled with the fixed base portion 204 of the first slide member 134. In other examples, one external frame, or more than two external frames 154 may be used. In addition, in FIG. 2 the stiffening member 140 illustrated as coupled with the third shelf 126 includes a first aperture 208 and a second aperture 210 therein. The first and second apertures 208 and 210 may be predetermined dimensions to receive a respective object, such as a container (not shown). For example, the first aperture 208 may be rectangular aperture sized to receive a rectangular container, such as a steel or plastic rectangular storage bin. In another example, the second aperture 210 may be a circular aperture sized to receive a circular container, such as a steel or plastic circular storage bin.

The external frame 154 may include a vertical section 212, or vertical leg, and a horizontal section 214, or horizontal leg. The horizontal section 214 may be coupled with the first slide member 134, and the vertical section 212 may be coupled with the second slide member 136. The horizontal section 214 extends transverse to the first slide member 134 below the base 122 past the opposing edges of the multi-level storage container 102. The horizontal section 214 includes a first member 218 pivotally coupled with a second member 220 by a hinge 222. The hinge 222 may be a jointed device that allows the first member 218 to pivot with respect to the second member 220. Accordingly, the horizontal section 214 may be "folded" to minimize the overall length of the horizontal section 214 thereby allowing the external frame 154 to be inserted through a relatively small opening in a cabinet. Following insertion of the "folded" horizontal section 214 into the cabinet, the external frame 154 may then be "unfolded" and fixedly coupled, to mount the multi-level storage container 102 in the cabinet.

The horizontal section 214 may be coupled with the bottom surface, such as a bottom interior surface of a cabinet in which the multi-level storage container 102 is mounted. The first member 218 may include a flange portion 224 extending transverse to a horizontal portion of the first member 218. The flange portion 224 may be coupled with the fixed base portion 204 of the first slide member 134. The flange portion 224 may be contiguously formed as part of the first member 218. In other examples, the flange portion 224 may be other than transverse to the horizontal portion of the first member 214. The first and second members 218 and 220, and the flange 224 may include apertures 228 sized to receive a fastener such as a screw, rivet, nail, or other rigid material that holds and maintains contiguous contact between independent members. Accordingly, the first and second members 218 and 220 may be fixedly coupled with a bottom surface of the cabinet by fasteners extending through the apertures 228.

Figure 3:
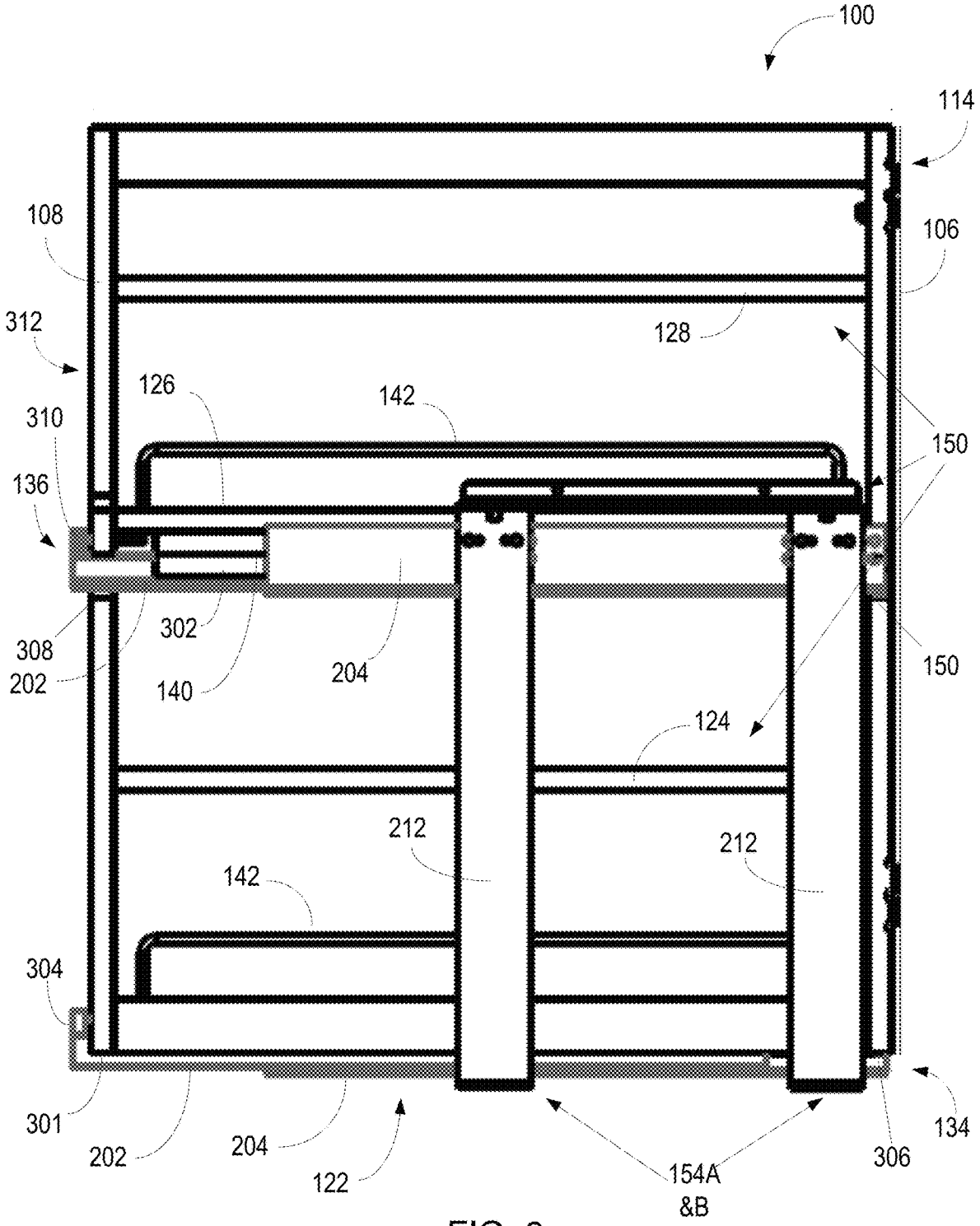
FIG. 3 is a side view of an example of multi-level storage system.

FIG. 3 is a side view of an example of the multi-level storage system 100. In the example of FIG. 3, the external frame 154 (first and second external frames 154A and 154B) may be a rigid unitary structure with the vertical section 212 of the external frame 154 extending transverse to the second slide member 136 and the shelves 120, 124, 126 and 128. Thus, the vertical member 212 extends from the first shelf 120 at the base 122 to an upper shelf 123, such as the third shelf 126. Unless otherwise indicated, the features and functionality of the multi-level cabinet system 100 discussed with reference to FIGS. 1 and 2 are similar to the features and functionality of the multi-level cabinet system 100 discussed with reference to FIG. 3. Accordingly, for purposes of brevity the details of these features and functionality will not be fully repeated, and it should be understood that features and functionality are fully interchangeable, combinable, and/or useable in the example systems described herein.

In FIG. 3, the fixed base portion 204 of the first slide member 134 is fixedly coupled with respective flanges 224 (FIG. 2) of the external frame 154A and 1546. The slidable portion 202 of the first slide member 134 extends through an aperture 301 included in the rear vertical member 108. The slideable portion 202 includes a termination bracket 304 for coupling the first slide member 134 to the rear vertical portion 108. In other examples, the termination bracket 304 may be omitted and the slideable portion 202 may be directly coupled with the rear vertical portion 108, such as by fasteners extending through apertures formed in the slideable portion 202. The fixed portion of the first slide member 134 is coupled with the flange 224 of the horizontal section 214 (FIG. 2) of the external frame 154 and extends horizontally along the first horizontal shelf 120 and the base 122 into an aperture 306 formed in the front vertical member 106. The first slide member 134 may be coupled with the front vertical member 106 by a termination bracket or direct coupling via fasteners so as to not extend past the front face 114 of the front vertical member 106.

In FIG. 3, the third shelf 126 is coupled with the stiffening member 140. In addition, the stiffening member 140 is coupled with a trim member 302. The trim member 302, stiffening member 140 and the third shelf 126 are contiguously aligned and coupled to provide a coupling location for the slideable portion 202 of the second slide member 136. In other examples, the trim member 302 may be omitted.

The slidable portion 202 of the second slide member 136 may extend through an aperture 308 formed in the rear vertical member 108, and include a termination bracket 310 for coupling an end of the second slide member 136 with a rear surface 312 of the rear vertical member 108, such as by fasteners. In other examples, the termination bracket 310 may be coupled to the rear vertical member 108 in the aperture 308. The fixed base portion 204 of the second slide member 136 may be fixedly coupled with the vertical section 212 of the external frame 154, such as by fasteners 316. The fixed base portion 204 of the second slide member 136 may extend horizontally parallel to and along an upper shelf 123, such as the third shelf 126, into the aperture 150 formed in the front vertical member 106.

Figure 4B:
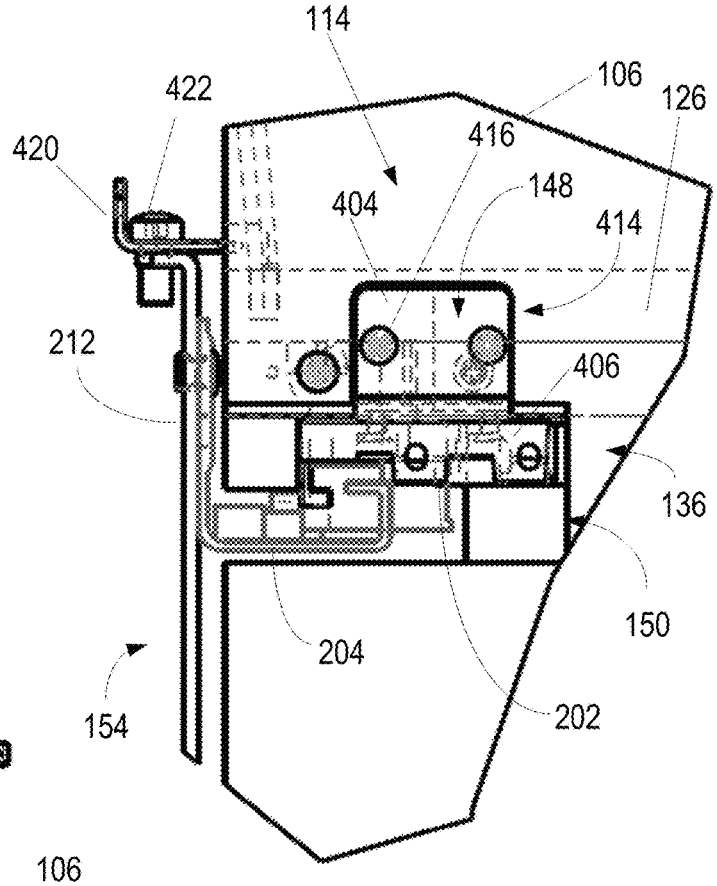
FIG. 4B is a front elevation view of a portion of the example multi-level cabinet system of FIG. 4A.
Figure 4A:
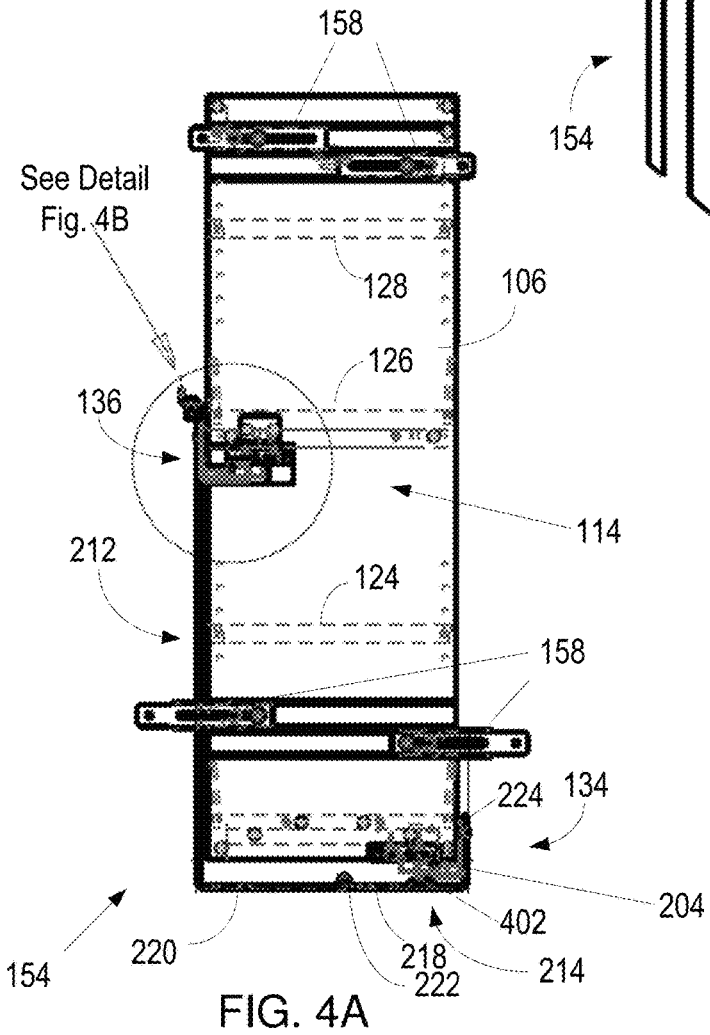
FIG. 4A is a front elevation view of an example multi-level cabinet system.

FIG. 4A is a front elevation view of an example multi-level cabinet system 100. FIG. 4B is a front elevation view of a portion of the example multi-level cabinet system of FIG. 4A. Unless otherwise indicated, the features and functionality of the multi-level cabinet system 100 discussed with reference to FIGS. 1 and 2 and 3 are similar to the features and functionality of the multi-level cabinet system 100 discussed with reference to FIGS. 4A and 4B. Accordingly, for purposes of brevity the details of these features and functionality will not be fully repeated, and it should be understood that features and functionality are fully interchangeable, combinable, and/or useable in the example systems described herein.

In FIG. 4A the front vertical member 106, which includes the front face 114 upon which a cabinet door (drawer or vertical) (not shown) can be flush mounted and securely coupled using the support brackets 158. The external frame 154 includes the vertical section 212 and the horizontal section 214. The external frame 154 is a rigid structure that is fixedly coupled to the first slide member 134 and the second slide member 136. The horizontal portion 214 includes the first section 218 and the second section 220 which are pivotably coupled by a hinge 222 to facilitate installation of the multi-level cabinet system 100 in a cabinet.

The first section 218 of the external frame 154 includes the flange 224, which is fixedly coupled to the fixed base portion 204 of the first slide member 134. The first section 218 may also include a support 402 extending vertically above a surface of the first section 218 to contact the fixed base portion 204 of the first slide member 134. An example of the support 402 is described in U.S. Pat. No. 9,756,941 issued Sep. 12, 2017, which is incorporated herein in its entirety.

FIG. 4B is a detailed view of a portion of the multi-level cabinet system 100 of FIG. 4A. In FIG. 4B, the second slide member 136 is illustrated as coupled, such as by a fastener, to the vertical section 212 of the external frame 154 by the fixed base portion 204. The slidable portion 202 of the second slide member 136 is coupled with the keeper bracket 148 at a first end of the second slide member 136, by fasteners such that the first end is maintained in the aperture 150 formed in the front vertical member 106. The second slide member 136 may be maintained in the aperture 150 without contiguous contact with the front vertical member 106 by the keeper bracket 148.

Accordingly, the length of the second slide member 136 may be optimized to extend from the front vertical member 106 to the rear vertical member 108. In an example, the length of the second slide member 136 may be 566*mm* such that the storage container may fully extend from a cabinet without over travel. In this configuration, the slidable portion 202 of the second slide member 136, along with the multi-level storage container 102 may slide in and out without the front and rear vertical sections 106 and 108 contacting the fixed base portion 204, or a cabinet in which the multi-level storage container 102 is mounted. In addition, since the second slide member 136 extends through the aperture 308 in the rear vertical member 108 and into the aperture 150 in the front vertical member 106, the storage container 102 may be fully extended from a cabinet in which the storage container 102 is mounted.

Full extension of the storage container 102 allows accessibility from outside a cabinet to all areas of the shelves 122, 124, 216 and 128 without a user reaching into the cabinet, including those areas proximate the rear vertical member 108. When fully extended, the rear vertical member 108 may occupy substantially the same position the front vertical member 106 or front face 114 occupies when the storage container 102 is fully retracted into a cabinet. In other words, the rear vertical member 108 may be positioned proximate a face frame of the cabinet when the storage container 102 is fully extended. The first slide member 134 is of a similar length by extending from the front vertical member 106 to the rear vertical member 108 to similarly provide full extension of the storage container 102 when slideably extended on the first and second slide members 134 and 136.

In addition to being coupled with the second slide member 136, the keeper bracket 148 is also coupled with the front face surface 114 of the front vertical member 106 and positioned to extend into the aperture 150. In the illustrated example, the keeper bracket 148 is a unitary structure that includes a first planar member 404 extending parallel to the front face 114 and a second planar member 406 transverse to the first planar member 404, which extends into the aperture 150 in a plane parallel with the second slide member 136. In an example, the first member 404 and the second member 406 are planar members positioned in perpendicular planes. Thus, the end of the second slide member 136 is coupled with second member 406 in the keeper bracket 148 in the aperture 150, such as by one or more fasteners.

Since the front face 114 of the front vertical member 106 is provided to flush mount a cabinet cover or drawer cover thereon, the keeper bracket 148 may be mounted in a recessed area 414 in the front face 114, and the second slide member 136 is positioned not to extend out of the aperture 150 past the front face 114. The first planar member 404 may be coupled with the front face 114 in the recessed area 414 by fasteners 416, such as screws or rivets or some other coupling mechanism.

The vertical section 212 of the external frame 154 may be coupled with a side wall surface of a cabinet in which the multi-level cabinet storage system 100 is mounted. In the illustrated example, a coupling bracket 420 is coupled with the vertical section 212 by one or more fasteners 422 and is configured for coupling via fasteners (not shown) with the side wall of a cabinet. In other examples, the vertical section 212 may be direct coupled with the side wall surface of a cabinet and the coupling bracket 420 may be omitted. In the direct connection example, the vertical section 212 may, for example, include apertures for direct coupling with a side wall of a cabinet using fasteners. The coupling with the side wall 116 of a cabinet may be adjustable to horizontally align the cabinet storage system 100 in a cabinet. For example, apertures included in the coupling bracket 420, or in the vertical section may be enlarged, such as to form slots. These slots may provide a point of horizontal adjustment to align the multi-level cabinet storage system 100 in a cabinet, so as to align a drawer face or cabinet face in an opening in a cabinet in which the multi-level cabinet storage system 100 is installed. The drawer face or cabinet face may be fixedly position on the front face 114 of the storage container 102. Upon aligning the multi-level cabinet storage system 100, the fastener(s) 422 may be tightened to frictionally and rigidly maintain the aligned position of the multi-level cabinet storage system 100.

Figure 5B:
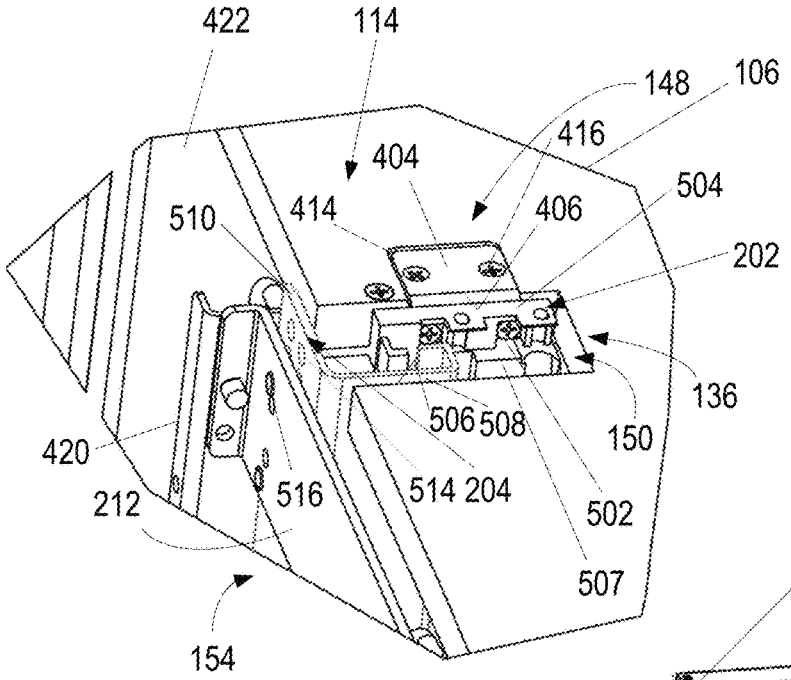
FIG. 5B is a bottom left perspective view of a portion of the example multi-level cabinet system of FIG. 5A.
Figure 5A:
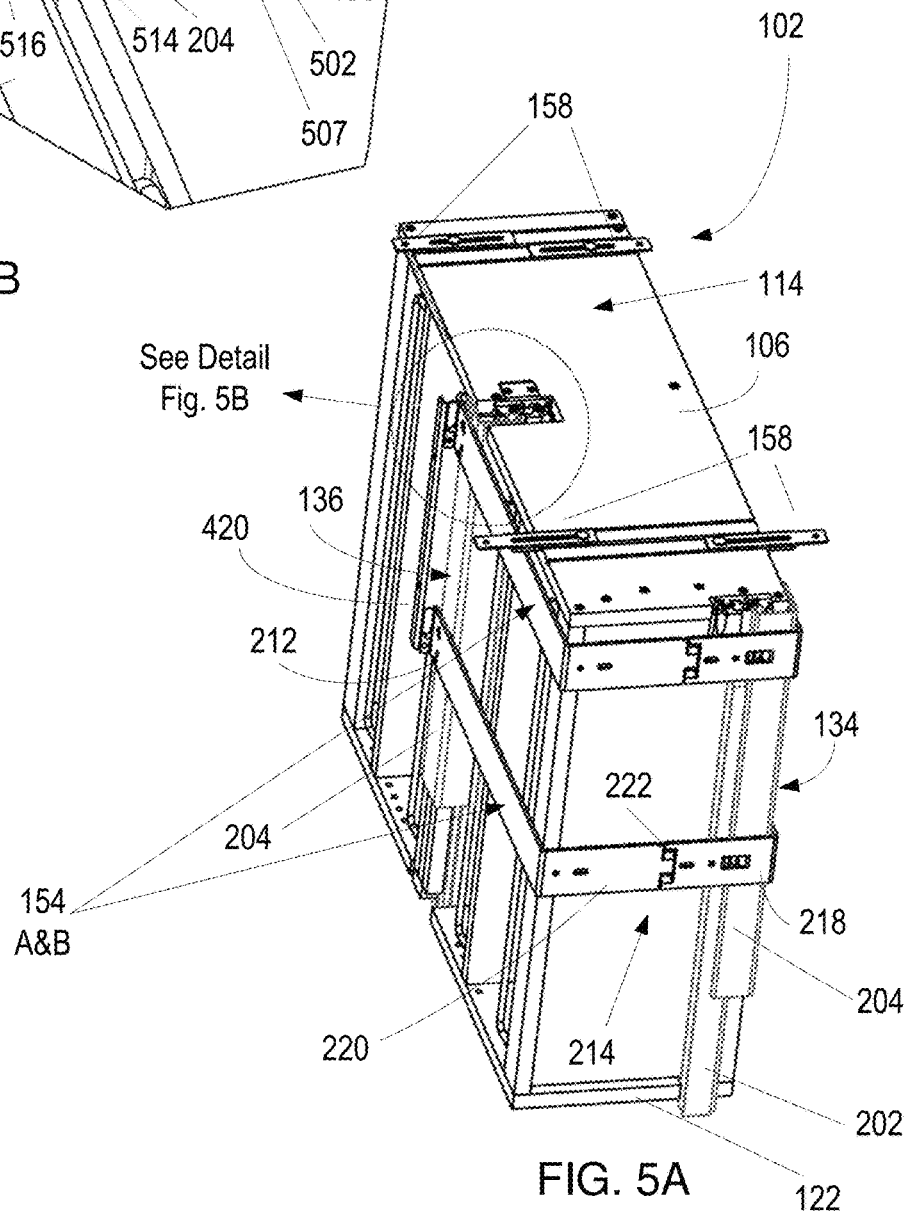
FIG. 5A is a bottom left perspective view of an example multi-level cabinet system.

FIG. 5A is a perspective bottom left view of another example of a multi-level cabinet system 100. FIG. 5B is Unless otherwise indicated, the features and functionality of the multi-level cabinet system 100 discussed with reference to FIGS. 1 and 2 and 3 and 4A and 4B are similar to the features and functionality of the multi-level cabinet system 100 discussed with reference to FIGS. 5A and 5B. Accordingly, for purposes of brevity the details of these features and functionality will not be fully repeated, and it should be understood that features and functionality are fully interchangeable, combinable, and/or useable in the example systems described herein.

In the example of FIG. 5A, two brackets 154 are illustrated, however, in other examples a single bracket, or greater than two brackets are possible. The horizontal section 214 of the bracket 154 is coupled with the fixed base portion 204 of the first slide member 134 and includes the hinge 222 separating the first section 218 from the second section 220. The slideable portion 202 of the first slide member 134 is coupled with the base 122 as illustrated. The bracket 154 also includes the vertical section 212, which is coupled with the fixed base portion 204 of the second slidable member 136 and the bracket 420. The bracket 420 is also coupled to the vertical section 212 via a fastener, which provides for horizontal adjustment of the cabinet storage system 100 within a cabinet in which the cabinet storage system 100 is positioned. Horizontal adjustment allows the drawer or cabinet face to be aligned in an aperture in a cabinet in which the cabinet storage system 100 is disposed.

As illustrated in FIG. 5B, the slidable portion 202 of the second slidable member 136 may be coupled with the keeper bracket 148 within the aperture 150 by fasteners 502 such that an end 504 (second end) of the slidable portion 202 does not extend beyond the front face 114. During assembly, a second planar member 406 of the keeper bracket 148 may be coupled with the slidable portion 202 first, before the end 504 of the slidable portion 202 is positioned in the aperture 150. In this way, a tool, such as a screwdriver, may be used to install the fastener 502. Once the slidable portion 202 is coupled with the keeper bracket 148, the first planar member 404 may be positioned in the recessed area 414, and coupled with the front face 114. Upon coupling the keeper bracket 148 with the front face 114, the fixed base portion 204 of the second slide member 136 may be spaced away from an edge 506 of the vertical member 106 such that there is no contact as the storage container 102 is slid between a retracted and an extended position. In addition, a release lever 507 included in the second slide member 136 may extend into the aperture 150 and be spaced away from the edge 506 of the vertical member 106 so that the release lever 507 is pivotable within the aperture 150 to release the slidable portion 202 from the fixed base portion 204.

In addition, the fixed base portion 204 may include a horizontal strut 508 forming a track in which the slidable portion 202 slides. The horizontal strut 508 forms a planar surface that extends out of the aperture 150 to a vertical strut 510. The vertical strut 510 is a planar surface that is transposed to the horizontal strut 508 and may extend vertically above the aperture and along an outside edge of at least one of the trim member 302, the stiffening member 140 and/or the upper shelf 123, such as the third shelf 126. In an example, the vertical strut 510 includes apertures 514 through which fasteners 516, such as rivets, may extend to rigidly couple the second slide member 136, more specifically the fixed base portion 204, in one or more places to the bracket 154. The fixed base portion 204 of the second slide member 136 is also positioned in the aperture 150 when the storage container 102 is slid into a cabinet. Accordingly, neither the slidable portion 202 nor the fixed base portion 204 extend beyond the front face 114 when the storage container 102 is fully retracted into a cabinet.

Figure 6:
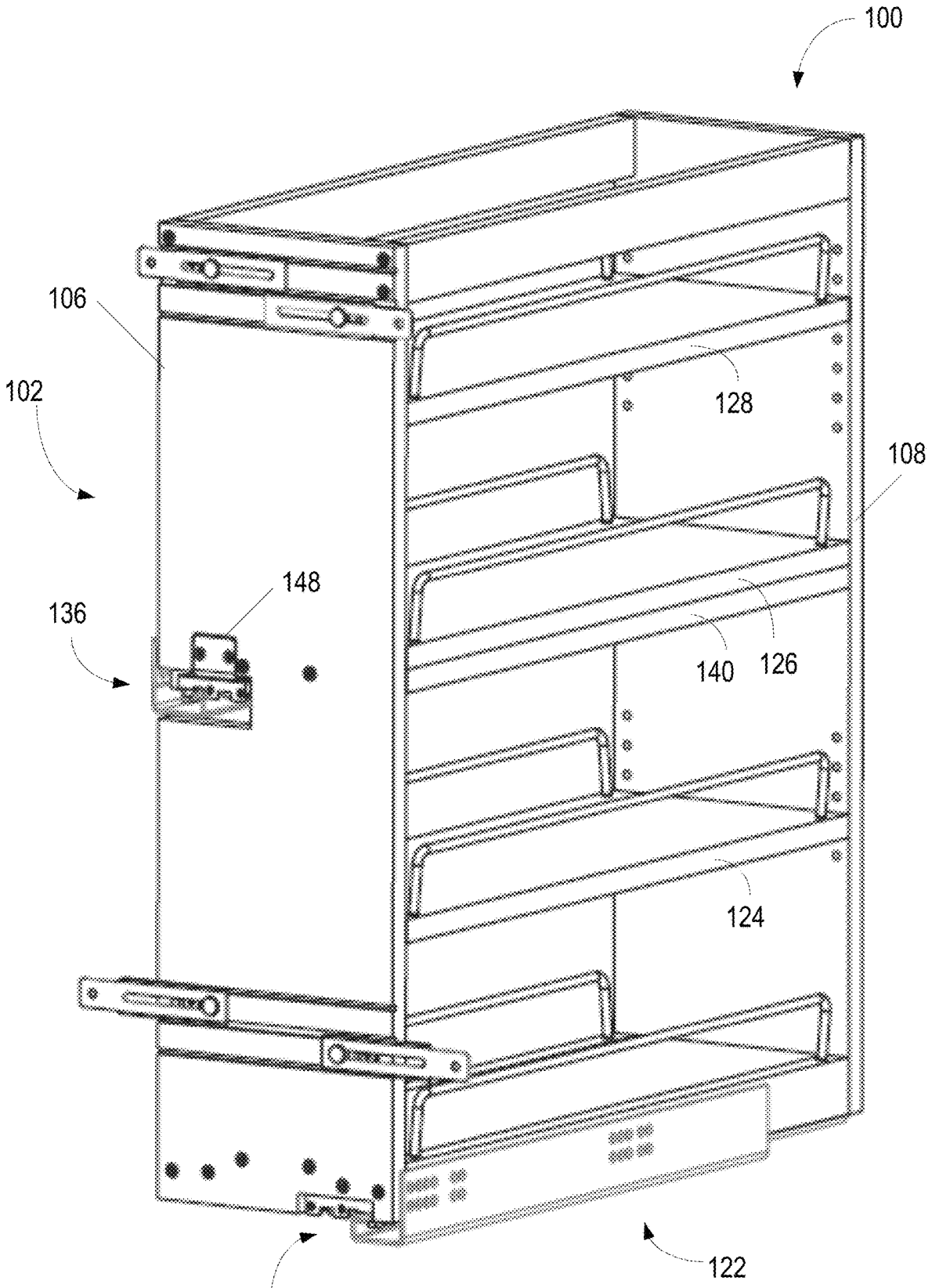
FIG. 6 is perspective view of an example multi-level cabinet storage system.

FIG. 6 is a perspective view of another example of a multi-level cabinet system 100. Unless otherwise indicated, the features and functionality of the multi-level cabinet system 100 discussed with reference to FIGS. 1 and 2 and 3 and 4A and 4B and 5A and 5B are similar to the features and functionality of the multi-level cabinet system 100 discussed with reference to FIG. 6. Accordingly, for purposes of brevity the details of these features and functionality will not be fully repeated, and it should be understood that features and functionality are fully interchangeable, combinable, and/or useable in the example systems described herein.

In the example of FIG. 6, the multi-level cabinet system 100 includes the multi-level storage container 102 having vertically spaced horizontal shelves 120, 124, 126, and 128 positioned between opposing vertical members 106 and 108 and a set of slide members, which include a first slide member 134 and a second slide member 136. The multi-level storage container 102 is installed in a cabinet to be slidably extendible horizontally and in parallel to first and second slide members 134 and 136. The first slide member 134 may be couple with a base 122 of the multi-level storage container 102, and the second slide member 136 may be coupled with at least one of the front or the rear vertical members 106 and 108 by the keeper bracket 148.

In the example of FIG. 6, the first slide member 134 and the second slide member 136 are not coupled with an external frame. Instead, each of the first slide member 134 and the second slide member 136 are coupled directly with the cabinet in which the multi-level storage system 100 is installed and the external frame is omitted. In this example, structural support against warping, twisting, vibration and the like of the multi-level storage container 102 is provided by the rigid structure of the cabinet.

Referring to FIGS. 1-6, the multi-level storage container 102 is slidable between a position of being fully disposed in a cabinet and extending external to the cabinet using the first and second slide members 134 and 136. By coupling the first slide member with the base 122 of the multi-level storage container 102, and coupling the second slide member 136 with an upper shelf (124 or 126) via the keeper bracket 148, the multi-level storage container 102 provides rigid and sturdy shelves supporting storage of goods and materials thereon. In addition, the first and second slide members 134 and 136 are vertically offset and coupled with opposing sides of the multi-level storage container 102 to improve stability when the multi-level storage container 102 is either fully retracted into a cabinet, or is fully extended out of the cabinet in which the multi-level storage container is mounted. Further, when the external frame 154 is used, the first and second slide members 134 and 136 are fixedly coupled to each other and the cabinet via one or more of the external frame 154 to minimize vibration, twisting, and swaying of the multi-level storage container 152 during slidable movement.

It is now apparent that there are many advantages of the multi-level cabinet system 100 provided herein. In addition to the advantages that have been described, it is also possible that there are still other advantages that are not currently recognized but which may become apparent at a later time.

While preferred embodiments of the cabinet slide system have been described, it should be understood that the disclosure is not limiting, and modifications may be made without departing from the features and functionality described. The scope of the disclosure is defined by the appended claims, and all devices that come within the meaning of the claims, either literally or by equivalence, are intended to embrace them.

What is claimed is:

1. A cabinet storage system comprising:

a multi-level storage container comprising a plurality of shelves horizontally coupled between vertical opposing members, the shelves including a bottom shelf and a plurality of upper shelves aligned in a vertically spaced apart configuration, and the vertical opposing members comprising a rear vertical member and a front vertical member;

a first slide member having a slidable portion coupled at a base of the multi-level storage container with the front vertical member and the rear vertical member;

a second slide member having a slidable portion coupled at a first end with the rear vertical member and positioned between two of the upper shelves to extend parallel with, and along, a horizontal surface of one of the upper shelves into an aperture formed in the front vertical member;

a keeper bracket removably coupled, by fasteners within the aperture, with the front vertical member and a second end of the slideable portion of the second slide member to rigidly maintain the second slide member in the aperture such that a fixed base portion of the second slide member extends into the aperture without contacting the front vertical member; and an external frame comprising a plurality of brackets, each of the brackets including a horizontal section and a vertical section formed as a contiguous rigid mounting structure; and a coupling bracket extending horizontally and coupling together the vertical section of each of the brackets, the coupling bracket to mount the multi-level storage container to a sidewall of a cabinet, and the horizontal section coupled with the fixed based portion of the first slide member to mount the multi-level storage container to a bottom of the cabinet, the horizontal section of each bracket of the external frame coupled with a fixed base portion of the first slide member and the fixed base portion of the second slide member coupled with the vertical section of each of the brackets.

2. The cabinet storage system of claim 1, wherein the keeper bracket is coupled with an outer surface of the front vertical member, the outer surface opposite an inner surface of the front vertical member that is coupled with the plurality of shelves.

3. The cabinet storage system of claim 2, wherein the keeper bracket includes a first planar member and a second planar member, the first planar member positioned on the surface of the front vertical member, and the second planar member transverse to the first planar member and coupled with a second end of the second slide member.

4. The cabinet storage system of claim 1, wherein the second slide member extends into an aperture formed in the rear vertical member between the two of the upper shelves.

5. The cabinet storage system of claim 1, wherein the first end of the second slide member extends through an aperture formed in the rear vertical member, the apertures positioned in the rear vertical member and the front vertical member between the two of the upper shelves.

6. The cabinet storage system of claim 1, wherein the horizontal section extends transverse to the first slide member below the base and is rigidly coupled with the fixed base portion of the first slide member, the vertical section extends transverse to the second slide member and the shelves and is adjustably coupled with the fixed base portion of the second slide member, and the coupling bracket extends parallel to the second slide member and the shelves.

7. The cabinet storage system of claim 1, wherein the external frame comprises a rigid unitary structure configured to rigidly couple with the cabinet in which the multi-level storage container is mounted, and the multi-level storage container rigidly slidable with respect to the external frame using the first slide member and the second slide member.

8. A cabinet storage system comprising:

a multi-level storage container comprising a first horizontal shelf in a vertically spaced relation to a second horizontal shelf;

a front vertical member and a rear vertical member, the first horizontal shelf and the second horizontal shelf transversely coupled between the front vertical member and the rear vertical member;

a first slide member and a second slide member each having a fixed base portion and a slidable portion, and being coupled at opposing sides of the multi-level storage container;

an external frame comprising a plurality of brackets, each of the brackets comprising a horizontal section coupled with the fixed base portion of the first slide member and a vertical section coupled with the fixed base portion of the second slide member and a coupling bracket extending between the vertical section of adjacently positioned brackets, the horizontal section mounted to a base of a cabinet via fasteners and the vertical section mounted via the coupling bracket to a side wall of the cabinet;

the first slide member extending horizontally along the first horizontal shelf and the second slide member extending horizontally along the second horizontal shelf into respective apertures formed in the front and rear vertical members between the first horizontal shelf and the second horizontal shelf; and a keeper bracket coupled with the front vertical member by fasteners in the respective aperture of the front vertical member, the keeper bracket also coupled with the slideable portion of the second slide member in the respective aperture of the front vertical member to rigidly maintain the fixed base portion of the second slide member positioned in the aperture spaced away from the front vertical member.

9. The cabinet storage system of claim 8, wherein the rear vertical member includes an inner surface and an opposing outer surface, the first horizontal shelf and the second horizontal shelf coupled with the inner surface, and the second slide member extends through the respective aperture included in the rear vertical member and is coupled with opposing outer surface of the rear vertical member.

10. The cabinet storage system of claim 8, wherein the front vertical member includes a front face configured to flush mount a cabinet drawer or door thereon, and the keeper bracket is rigidly mounted on the front face in a recessed area behind the cabinet drawer or door and extending into the aperture in the front vertical member.

11. The cabinet storage system of claim 8, wherein the keeper bracket is fixedly coupled with the slideable portion of the second slide member to maintain the fixed base portion of the second slide member in the respective aperture of the front member without contiguous contact of the fixed base portion of the second slide member with the multi-level storage container.

12. The cabinet storage system of claim 8, wherein the vertical section of each bracket extends vertically from the first horizontal shelf toward to the coupling bracket coupled at a top end of the vertical section of each bracket, the vertical section of each bracket positioned with respect to the second horizontal shelf to adjustably couple with the second slide member and enable adjustable positioning of the second slide member on the vertical section of each bracket.

13. The cabinet storage system of claim 12, wherein the horizontal section of the external frame extends to the opposing sides of the multi-level storage container and includes a first member pivotally engage with a second member at a pivot point forming a hinge, the horizontal section foldable at the pivot point.

14. The cabinet storage system of claim 13, wherein the first member of the horizontal section includes a flange positioned proximate the first slide member to contiguously contact and support the first slide member.

15. A cabinet storage system comprising:

a multi-level storage container comprising a plurality of vertically spaced horizontal shelves positioned between and coupled with a respective inner surface of opposing first and second vertical members, the multi-level storage container also comprising a set of slide members for slideably mounting the multi-level storage container in a cabinet to extend horizontally out of the cabinet in parallel to a first slide member and a second slide member included in the set of slide members, the first slide member coupled with a base of the slidable multi-level storage container and the second slide member extending through respective apertures included in each of the opposing vertical members, the respective apertures formed to extend from the inner surface to the opposing outer surface of the opposing vertical members between two of the vertically spaced horizontal shelves;

a keeper bracket coupled with one of the opposing members and the second slide member to rigidly maintain the second slide member in the respective aperture;

an external frame a plurality of brackets, each of the brackets having a horizontal leg and a vertical leg, the horizontal leg coupled with the first slide member and a bottom surface of the cabinet in which the multi-level storage container is slideably mounted, and the vertical leg coupled with the second slide member; and a coupling bracket coupled with each vertical leg of the brackets to horizontally extend between the brackets and provide coupling via fasteners with a side wall surface of the cabinet, the side wall surface being a vertical extending surface positioned horizontally adjacent the slidable multi-level storage container.

16. The cabinet storage system of claim 15, wherein second slide member includes a stationary portion and a slideable portion extending into the respective aperture formed in one of the opposing vertical members, the keeper bracket extending into the respective aperture to couple with the slideable portion such that the stationary portion is rigidly positioned in the respective aperture spaced away from the one of the opposing vertical members.

* * * * *